US009080575B2

(12) United States Patent
Sheard et al.

(10) Patent No.: US 9,080,575 B2
(45) Date of Patent: Jul. 14, 2015

(54) METHOD OF DETECTING AND CONTROLLING STALL IN AN AXIAL FAN

(75) Inventors: Anthony Geoffrey Sheard, Colchester (GB); Alessandro Corsini, Rome (IT); Stefano Bianchi, Rome (IT)

(73) Assignee: HOWDEN AXIAL FANS AB, Vaxjo (SE)

( * ) Notice: Subject to any disclaimer, the term of this patent is extended or adjusted under 35 U.S.C. 154(b) by 909 days.

(21) Appl. No.: 13/036,744

(22) Filed: Feb. 28, 2011

(65) Prior Publication Data

US 2012/0219398 A1 Aug. 30, 2012

(30) Foreign Application Priority Data

Mar. 1, 2010 (GB) ..... 1003370.2

(51) Int. Cl.
*F01D 21/02* (2006.01)
*F04D 27/00* (2006.01)
*F04D 19/00* (2006.01)

(52) U.S. Cl.
CPC ..... *F04D 27/001* (2013.01); *F04D 19/002* (2013.01)

(58) Field of Classification Search
USPC ..... 415/1, 16, 30, 48, 51, 118, 119; 416/30, 416/35, 44, 49, 61
See application file for complete search history.

(56) References Cited

U.S. PATENT DOCUMENTS

| | | | | |
|---|---|---|---|---|
| 3,872,292 | A * | 3/1975 | Dawson, Jr. | 700/79 |
| 2004/0037693 | A1 * | 2/2004 | Stabley et al. | 415/1 |
| 2008/0034753 | A1 * | 2/2008 | Furman et al. | 60/605.1 |
| 2008/0253877 | A1 * | 10/2008 | Bodell et al. | 415/13 |
| 2009/0003991 | A1 * | 1/2009 | Andarawis et al. | 415/118 |
| 2010/0011846 | A1 * | 1/2010 | Krok et al. | 73/112.06 |

OTHER PUBLICATIONS

Wu, Jian-Da and Chuang, Chao-Qin, Fault diagnosis of internal combustion engines using visual dot patterns of acoustic and vibration signals, Dec. 2005, Elsevier Ltd. NDT & E International, vol. 38, Issue 8, pp. 605-614.*

Sheard, et al., "Detection of Stall Regions in Low-Speed Axial Fan. Part II—Stall Warning by Visualization . . . "; ASME Turbo Expo 2010 (Jun. 14-18, 2010), pp. 1-10, Glasgow, UK.

* cited by examiner

*Primary Examiner* — Edward Look
*Assistant Examiner* — Aaron R Eastman
(74) *Attorney, Agent, or Firm* — Kacvinsky Daisak Bluni PLLC

(57) ABSTRACT

A method of detecting stall in an axial fan through acoustical measurements in air the air flow, includes measuring the sound emanating from the flow adjacent the fan, preparing a visual representation of the sound, comparing the visual representation with a library of fixed visual representations derived from a plurality of tests representative of the performance of the fan under a range of operating parameters, selecting the fixed visual representation most closely matching the visual representation of the said sound, and deriving a control signal from the selected fixed visual representation. The visual representations are formed by a symmetrised dot pattern (SDP) technique.

19 Claims, 5 Drawing Sheets

METHOD OF DETECTING AND CONTROLLING STALL IN AN AXIAL FAN

CROSS-REFERENCE TO RELATED APPLICATION(S)

This United States Non-Provisional Patent Application relies for priority on United Kingdom Patent Application No. GB 1003370.2, filed on 1 Mar. 2010, and issued on 26 Jan. 2011 as United Kingdom Patent No. 2468571, the contents of which are incorporated herein by reference.

FIELD OF THE INVENTION

The present invention relates to a method of detecting and controlling stall in an axial fan through acoustical measurement in the air flow.

DESCRIPTION OF RELATED ART

Because aerodynamic stall, that is aerodynamic flow instability, is a major potential cause of mechanical failure in axial fans, stall-detection techniques have had wide application for many years. The detection and analysis of the different forms of aerodynamic instability have been studied for several decades. Two main types of aerodynamic flow instability exist: (i) 'rotating stall' (in which regions of reversed flow occur locally); and (ii) 'surge' (which is characterised by periodic backflow over the entire annulus involving violent oscillations in the air flow which can result in mechanical failure such as fan blade breakage. Prior methods have had drawbacks in their inability to enable a sufficiently rapid response to the onset of stall to avoid damage and their inability to sense the approach to stall.

SUMMARY OF THE INVENTION

The present invention seeks to develop a stall-detection methodology able to differentiate between aerodynamic stall conditions that constitute a mechanical risk and those that do not, so that the resulting methodology is thus capable of differentiating between critical and non-critical conditions and the approach to a critical condition.

According to the present invention there is provided a method of detecting and controlling stall in an axial fan through acoustical measurements in the air flow, including measuring the sound emanating from the flow, preparing a visual representation of the sound, comparing the visual representation with a library of fixed visual representations derived from a plurality of tests representative of the performance of the fan under a range of operating parameters, selecting the fixed visual representation most closely matching the visual representation of the said sound, and, wherein the selected visual representation is used to generate a feed back control signal to control the operation and speed of the fan.

In one embodiment, the visual representations are formed by a symmetrised dot pattern (SDP) technique. The sound may be measured over a period of time covering less than 10 revolutions of the fan. The sound may be measured over less than three or even less than one revolution. The sound may be measured at a point adjacent the periphery of the fan.

The operating parameters may include normal flow, partial stall, full stall and/or incipient stall. The parameters may comprise different operating speeds of the fan, which may be 100%, 50% or 25% of the fan's rated speed.

The invention also provides apparatus adapted to carry out the method that includes, among other features, test means for creating a library of fixed visual representations of sound emanating from said fan under a range of operating parameters, a microphone for measuring actual sound emanating from the fan in operation, means to prepare a visual representation of the actual sound, comparison means for comparing the visual representation of the actual sound with the library of fixed visual representations and selecting the fixed visual representation which is the closest match to the visual representation of the actual sound, and control means adapted to be responsive to the selected visual representation to generate a feedback control signal to control the operation and the speed of the fan.

BRIEF DESCRIPTION OF THE DRAWINGS

One or more embodiments of the present method and apparatus will now be described by way of example, with reference to the accompanying drawings, in which.

DETAILED DESCRIPTION OF EMBODIMENT(S) OF THE INVENTION

Figure 1:
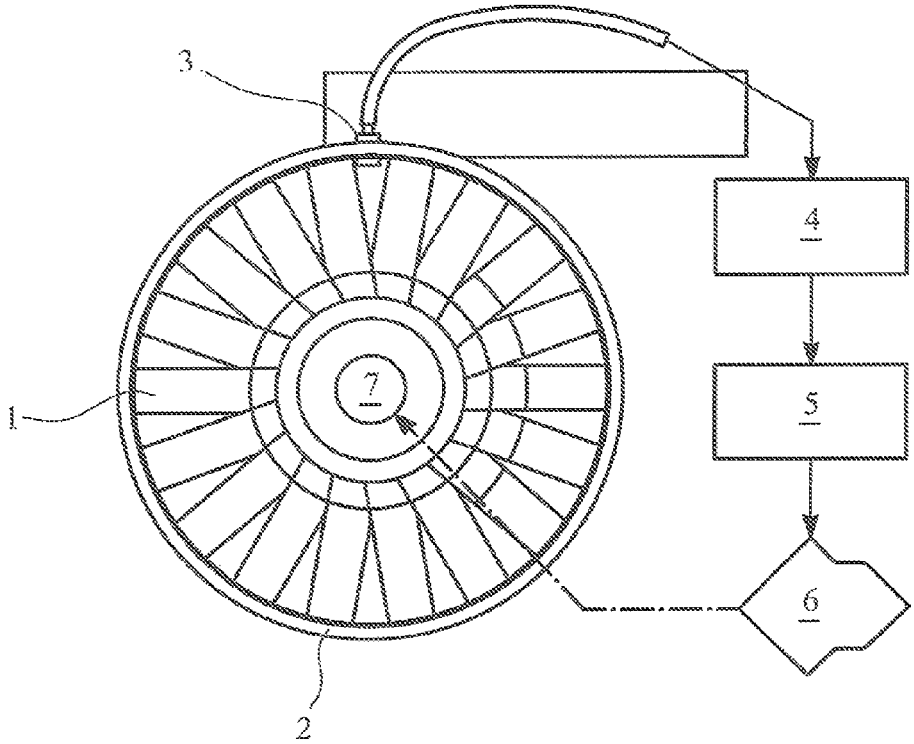
FIG. 1 shows an axial view of an axial fan in a casing.
Figure 2:
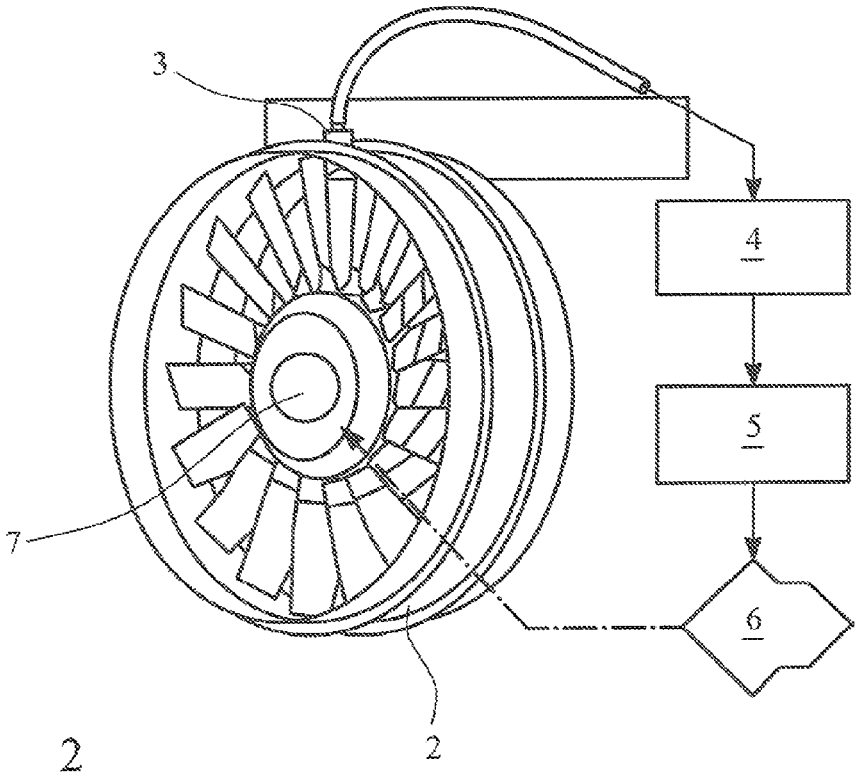
FIG. 2 shows a perspective view of the fan of FIG. 1.

FIGS. 1 and 2 show a multi-blade axial fan 1 mounted in a casing 2 by which the fan is mounted in a ducting for a ventilation system (not shown). One particular application of the fan is in a ventilation system for an underground railway system. In order to measure the sound of the air passing the fan, a high-sensitivity microphone 3 is mounted in the casing 2 adjacent the fan 1. In practice it is envisaged that the microphone can be placed some distance from the fan with little loss of efficiency in response. It is therefore possible to place the microphone, for example, at the positions 15*a* or 15*b* shown in dotted outline in FIG. 3. The microphone 3 has a frequency response of 5 Hz to 7 kHz±1 dB and 3.15 Hz 20 kHz±2 dB, a lower limiting frequency 1 Hz to 2 Hz.

Signals from the microphone 3 are transmitted at ten second intervals to an SDP processor 4, to be described in greater detail hereinafter, which generates a visual image representative of the sound generated by the air flow. The visual image is then transmitted to a comparator 5 which contains a reference library of fixed visual representations which correspond to a plurality of operating parameters of the fan obtained in a test rig, where the image is matched with the closest reference image in the comparator 5. This closest reference image then enables the generation of an appropriate control signal which forms a feed back signal 6 which is used to control the fan motor 7.

Figure 3:
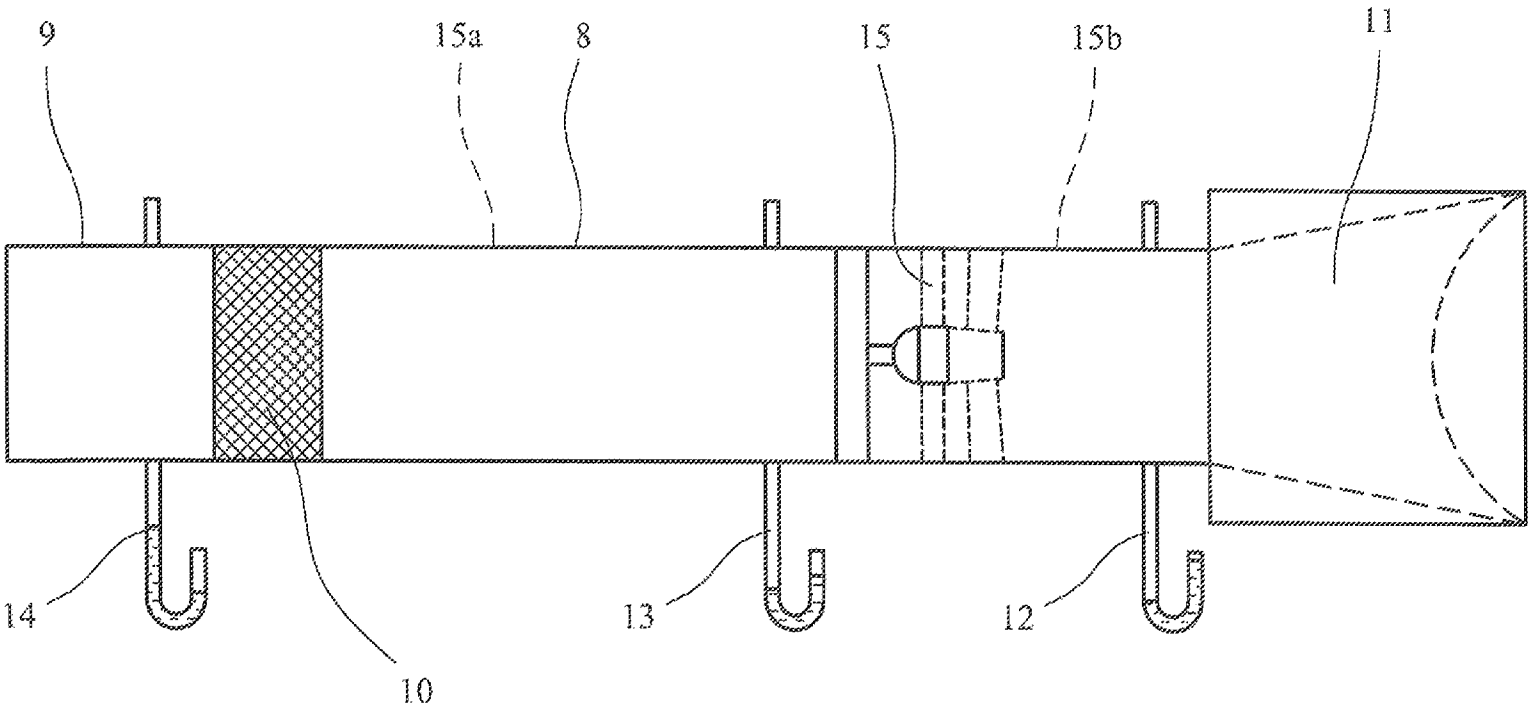
FIG. 3 shows a side view of a test rig.

The library of reference images is derived from series of tests carried on the fan in a test rig, shown schematically in FIG. 3. The fan 1 is mounted in a duct 8 with an inlet section 9 having a length about four times the fan diameter. The inlet 9 contains a flow straightener 10 to provide a substantially lamina air flow of a regular consistency to the fan 1. An adjustable throttle 11 is located downstream of the fan 1.

Transducers 12, 13, 14 to measure the pressure in the duct 8 are located upstream of the fan 1, between the fan 1 and the throttle 11, and in the inlet 9.

A microphone 3 can be flush mounted at position 15 in the fan casing. Acoustic data is collected from the microphone at full-, half-, and quarter-speed. These data are then processed to establish, for each speed, regions of: (i) stable aerodynamic operation; (ii) stall incipience; and (iii) rotating stall. Spatial and temporal correlations between rotating instabilities are established, which facilitates a full analysis of stall inception. The data is stored as a library of visual representations using a symmetrised dot pattern (SDP) technique. The SDP for a stall condition is different from that for a non-stall condition providing a basis for differentiation of the two. Surprisingly, it has been found that using this technique it is possible to detect incipient stall, that is the build-up to the transition from stable flow to rotating stall.

There is typically a rapid transition from normal to stall condition and the prior detection systems typically take up to 240 revolutions to react, by which time stall has fully developed with the risk of catastrophic damage already occurring. In contrast, the present invention can detect incipient stall in less than 10 revolutions, often less than 3 or even less than one, with the result that corrective action can be taken before rotating stall has developed.

All of these forms of aerodynamic instability place considerable mechanical stress on the rotors, which can eventually lead to mechanical failure. Strain gauge measurements have reported bending stress exceeding stable operation by a factor of five under 'rotating stall' conditions, leading to rapid fatigue failure of the blades. In contrast a 'surge' can lead to the magnitude of bending stress becoming higher enough to cause a mechanical failure during the surge event itself.

In the case of industrial fans such as those in ventilation systems for underground railways, new legislation making high temperature capability mandatory poses new challenges.

A particular feature of this environment within which the industrial fans operate is the pressure pulses associated with the movement of a train through a tunnel. Pressure pulses can be up to ±50% of the overall work coefficient. The effect of such pressure pulses on an industrial fan is to drive the fan first up, and then down, its characteristic operating range. To ensure that the fan continues to operate in an aerodynamically stable manner during this pressure transient, aerodynamic design of the fan requires the incorporation of sufficient margin to ensure that the fan does not stall due to high positive or negative inlet flow angle.

This propensity to stall under large pressure fluctuations is complicated in off-design conditions when a fan is operated at partial speeds. When a fan operates at 50% speed its flow and pressure-developing capability are reduced. Because the pressure pulse associated with a passing train remains constant, the fan stalls in positive incidence as the train approaches, and then stalls in negative incidence as the train departs. This combination of positive-incidence aerodynamic stall and negative-incidence aerodynamic stall causes a significant increase in the unsteady forces applied to the fan blades, which can result in a fatigue failure of the blades.

The mechanical stress on axial-fan blades caused by stalled operations can be higher in the case of industrial fans intended for high-temperature operations—such as those used in tunnel-emergency ventilation systems. To ensure reliable emergency operation, both the EN12101-3 and ISO 21927-3 standards require fans to have a larger tip gap (between the blades and the casing). However, although such an increased tip gap has a beneficial effect in facilitating emergency operation of a fan, it also has a detrimental effect on the aerodynamic and aeroacoustic performance of the fan during routine operations.

Surprisingly, it has been found that the use of a symmetrised dot pattern technique is particularly advantageous in detecting the approach to stall conditions, incipient stall, to enable corrective action to be taken before stress levels in the fan rise to dangerous levels. This has many practical as well as cost advantages in that service life is extended and a given level of performance can be obtained from a smaller fan because, in an underground railway system for example, it is possible for the normal operation of the fan to be conducted much closer to the operating point at which the fan will stall. The reasons for this are believed to be the following:

(1) The SDP is quite light on the signal processing requirement, so it is easier to conduct the signal processing in real time, and therefore identify signals as stall as it develops, as opposed to as stall that has already happened.

(2) The SDP process is very effective at working with very low signal to noise ratios.

(3) The SDP approach is very effective with signals from a microphone placed in any location. Known techniques for stall detection need a pressure measurement OVER THE BLADE. As such the SDP technique in combination with an acoustic measurement according to the invention is able to create a visual pattern that can be used to detect stall in any locations, not just with the microphone over the blade itself. Furthermore, it is possible to achieve the desired results using one microphone only, in contrast to the known arrangements which use multiple pressure transducers distributed about the periphery of the fan casing. The present invention therefore offers significant savings in the complexity of the equipment required and the complexity of processing the detected signals.

(4) Because of its low processing power requirements and its speed of processing the acoustic signals, the SDP technique has an advanced sensitivity and is therefore very good at producing features in the visual pattern that are linked to the approach of stall.

These advantages of SDP techniques do enable more sophisticated monitoring and control of fan performance. Aerodynamic stall does not always result in mechanical failure; indeed, a sub-sonic fan can sometimes operate at low speeds in an aerodynamically stalled condition without incurring mechanical failure. A full stall at 100% will typically result in early sudden fatigue failure. At some lower speed, which in the example shown can be said to be the 50% speed, the normal operating (direct) stress on the fan caused by fan rotation is sufficiently reduced to enable the additional alternating stress caused by stall to be tolerated without the risk of mechanical failure due to fatigue. The 50% speed will therefore be the design maximum critical speed for service operation To determine this speed for a given design of fan and installation, it is necessary to conduct laboratory tests to measure the direct and alternating stresses on the fan under various operating speeds and conditions. Once the safe maximum speed at which the fan can operate in stall without the risk of mechanical failure is determined, then a library of symmetrised dot patterns associated with normal operation, incipient stall and full stall can be determined for full 100% speed, the critical maximum allowed speed and a reduced speed or speeds such as 25% Thus at lower speeds, say 25% as shown in this example, the fan can operate in stall with no risk of fatigue failure.

Figure 6:
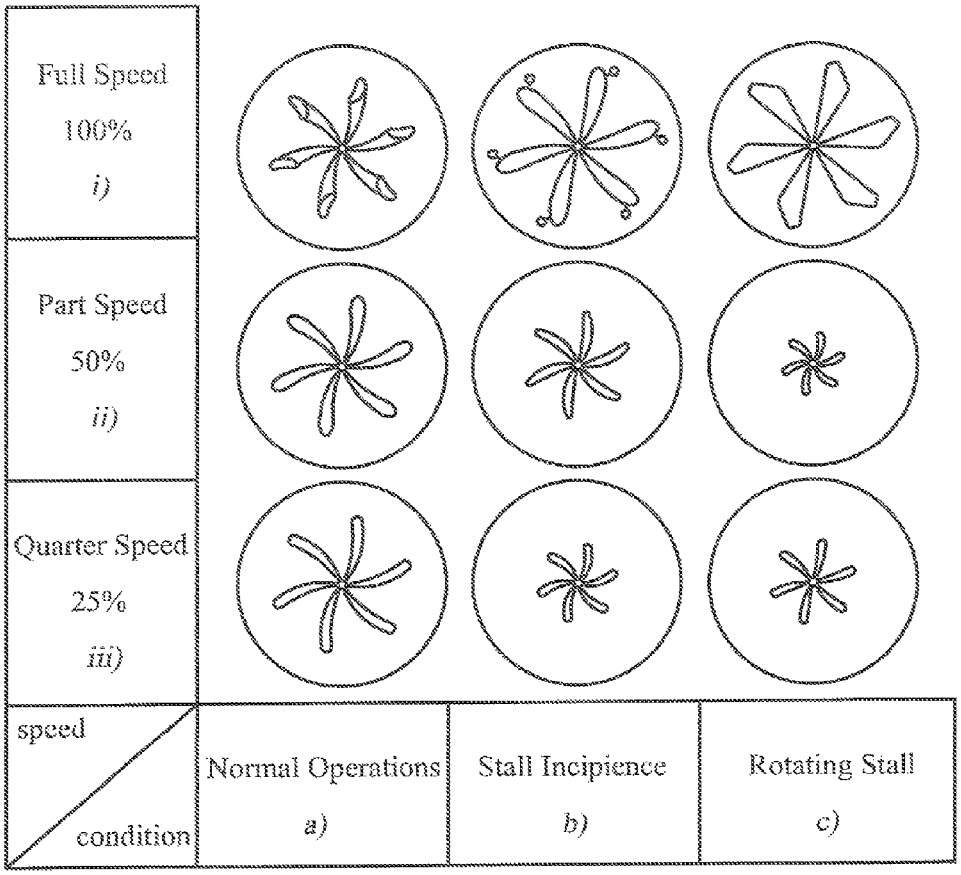
FIG. 6 shows the SDP of the casing wall pressure signals of the tested fan in different operating conditions and rotational speeds.

As shown in FIG. 6, operating in rotating stall at full speed, 6 *i*) *c*), provides a shape indicative of early failure, whereas operating at 25% provides a different shape, 6 *iii*) *c*), indicative of a safe working condition.

Using the library of SDPs, the matching template can then determine: (a) that the fan is approaching incipient stall, and/or (b) that the speed of the fan is such that in the full stall condition it is either going to result in impending failure (for example the SDP in FIG. 6 *i*)*c*) or is one at which the fan can operate quite safely (the SDP in FIG. 6 *iii*)*c* or FIG. 6 *ii*)*c*). The appropriate control action can then be taken. Thus the shape alone of the selected SDPs will indicate whether the fan has been running at above its safe design speed. There is no need to have a separate record of the fan running speed since the logging of the SDP data will provide all the data needed to determine the in-service history of the fan.

Background Information of Symmetrized Dot Pattern (SDP) Technique

Figure 4:
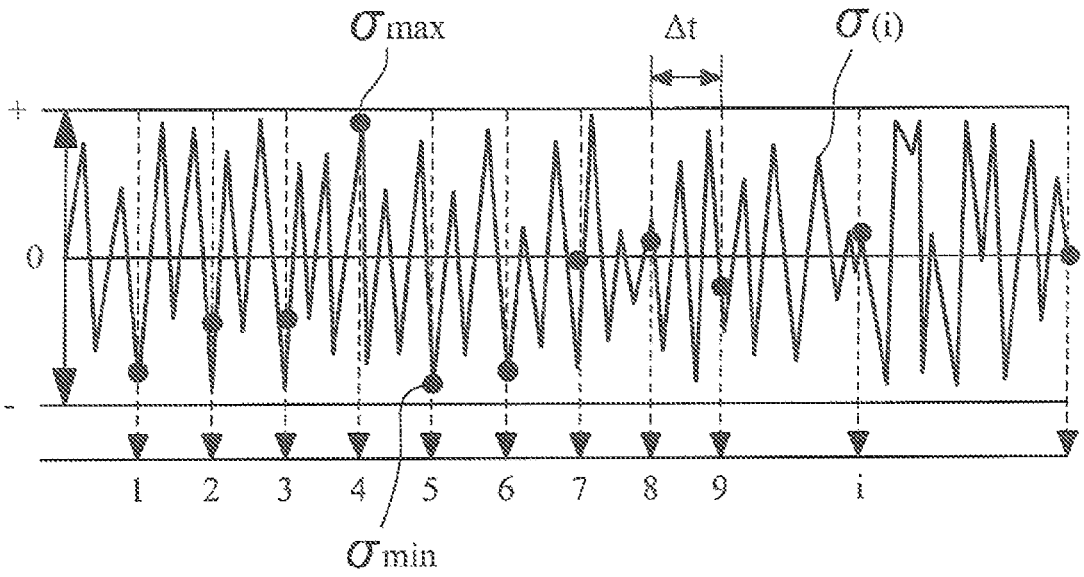
FIG. 4 shows a diagram of the technique for plotting symmetrised dot patterns (SDP)
Figure 4:
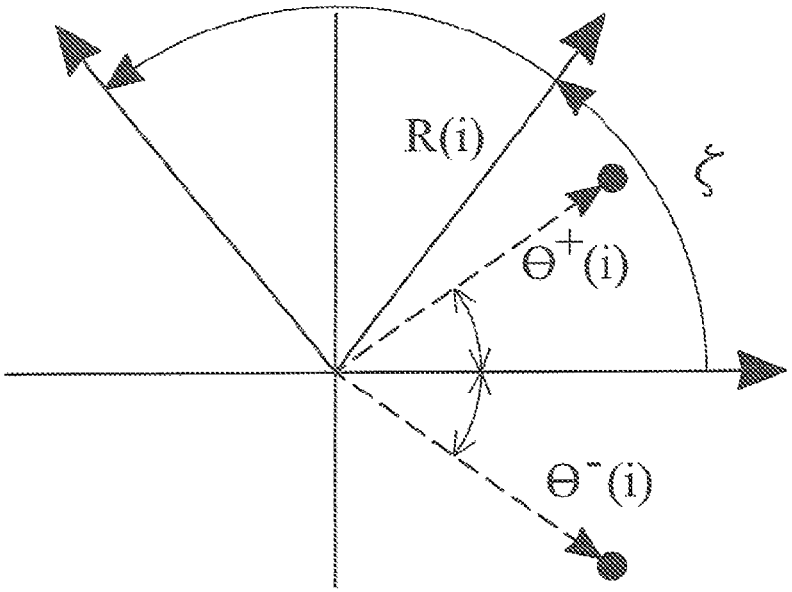

Researchers first conceived the technique developed in this paper for the visual characterization of speech waveforms in automatic human-voice recognition algorithms Developed to determine noise peculiarities, the methodology's merit is its ability to perceive otherwise 'unquantifiable' differences in sound signals. Experiments on psychological perception demonstrate that people perceive noise 'annoyance' not only by the sound power level (produced by tonal components) but also by 'howling' sounds and modulated signals. The SDP pattern provides a local visual correlation that can be applied to detect of the significant features of any signal, Mathematical Framework of Symmetrized Dot Pattern (SDP) Technique An algorithm that maps a normalised time waveform into symmetrised dot patterns on a polar graph produces SDPs. FIG. 4 shows the SDP plotting technique.

The input waveform is first normalised by finding the higher (σmax) and tower values (σmin) for the N points of data in the window. Overall amplitude is therefore, in general, nota factor in the characterization.

By creating a scatter plot of neighbour amplitudes on polar coordinates, the symmetrised dot pattern space is able to discriminate the frequency of the time signals and their variability.

Figure 5:
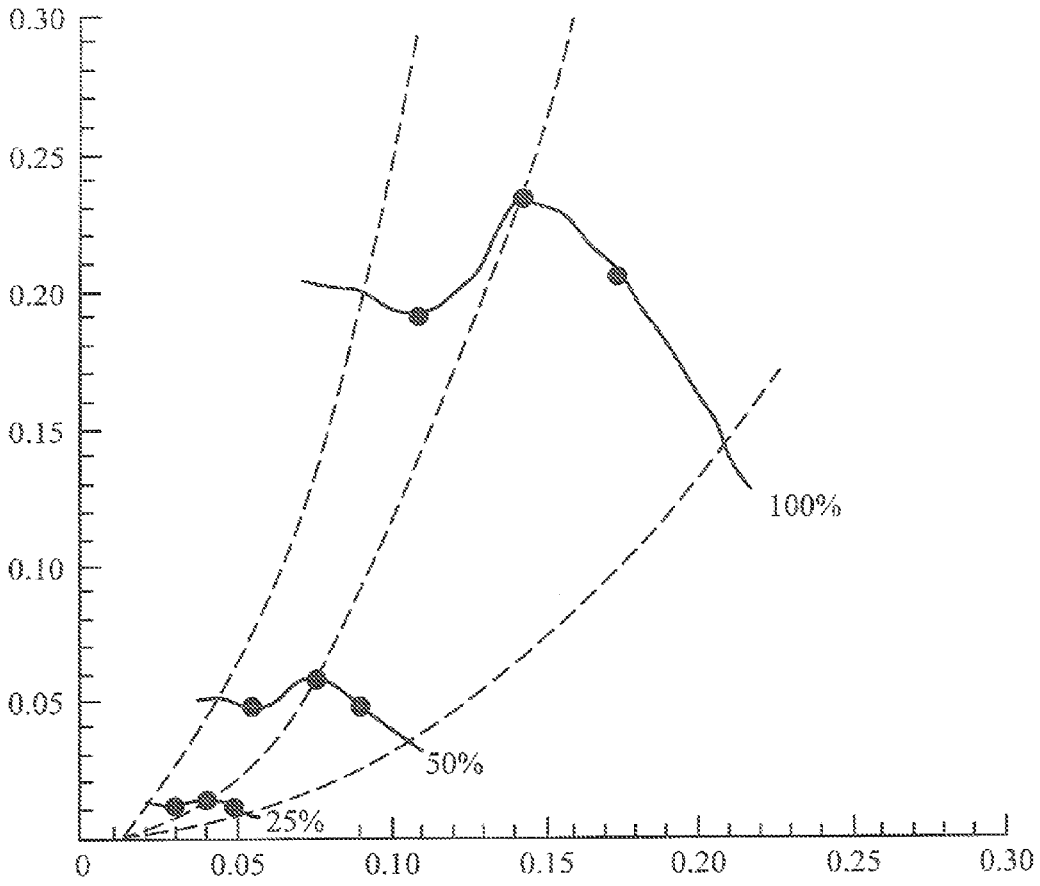
FIG. 5 shows a fan map of pressure plotted against overall air flow.

The analyses carried out on instantaneous pressure measurements on the casing wall had enabled to detect regions of safe and stalled operation. FIG. 5 shows the operating conditions chosen for the experimental verification of the proposed diagnostic approach. Three points were selected (at full speed and partial speed) to represent stable aerodynamic conditions, stall incipience and stalled operations.

The patterns as shown in FIG. 6, were derived by using an adequate set of SDP parameter and sampling time.

FIG. 6 represents the SDPs of the case-wall pressure signals at the operating conditions indicated in FIG. 5: a) normal operations, b) incipience of the aerodynamic instability and c) in the presence of rotating stall. The template patterns in FIG. 6 represents three rotational speeds: (i) 100% of the nominal rotor speed (ii) 50% of the nominal rotor speed and (iii) 25% of the nominal rotor speed. The fan's pressure signal dot patterns are used without any aerodynamic instability as a databank for the template image matching of the stall diagnosis, such that, in the proposed diagnostic tool, the software would proceed by comparing the shape of the SDPs from every sampling interval.

At design speed (FIG. 6(*i*)(*a*), the SDP for the normal operations had a peculiar shape, of a final ring on each of the six arms. This shape was demonstrated to be exclusive of this operating condition and it could be assumed to be a 'benchmark' of the machine signature when operating in the design point. Instability incipience (FIG. 6(*i*)(*b*) resulted in an increase in the SDP radius. Corresponding to the presence of the rotating stall operation (FIG. (*i*)(*c*), the dots were found to be spread covering a greater surface than previously.

Different behaviours when comparing the SDPs at half-speed and quarter-speed (FIGS. (*ii*)*a*-*c*). The pattern at half-speed reduced its radius (while keeping the angular dot distributions) when the fan was throttled down from stable to unstable conditions. Similar conclusions could be drawn by examining the quarter-speed signal evolution.

The invention claimed is:

1. A method of detecting and controlling stall in an axial fan through acoustical measurements in the air flow, comprising:

measuring the sound emanating from the flow;

preparing a visual representation of the sound;

comparing the visual representation with a library of fixed visual representations, the library of fixed visual representations derived from a plurality of tests representative of the performance of the fan under a range of operating parameters, wherein the library of fixed visual representations comprises a plurality of visual representations each depicting only one of: normal flow conditions, incipient stall conditions, and stall conditions;

selecting the fixed visual representation most closely matching the visual representation of the sound;

determining if the fan is approaching incipient stall based on the selected visual representation; and generating a feedback control signal to control the operation and speed of the fan when the fan is determined to be approaching incipient stall.

2. A method according to claim 1, wherein the visual representations are formed by a symmetrised dot pattern (SDP) technique.

3. A method according to claim 1, wherein the sound is measured over a period of time covering less than 10 revolutions of the fan.

4. A method according to claim 3, wherein the sound is measured over less than three revolutions.

5. A method according to claim 3, wherein the sound is measured over less than one revolution.

6. A method according to claim 1, wherein the parameters include different operating speeds of the fan.

7. A method according to claim 1, wherein the operating speeds include at least one selected from 100%, 50% and 25% of the fan's rated speed.

8. A method according to claim 1, wherein means for measuring the sound emanating from the flow comprises a microphone located adjacent the fan.

9. An apparatus comprising:

an axial fan;

a casing in which said axial fan is mounted;

a duct in which the casing is mounted;

a microphone coupled to the duct, the microphone for detecting acoustics of air flow through the duct, and for transmitting signals representative of the acoustics of said air flow;

a processor for receiving said signals from said microphone, for creating a visualization representing acoustics of said air flow, and for transmitting the visualization; and a comparator for:

receiving the visualization from the processor;

comparing the visualization to a reference library of fixed visual representations, wherein the library of fixed visual representations comprises a plurality of visual representations each depicting only one of: normal flow conditions, incipient stall conditions, and stall conditions;

determining if the fan is approaching incipient stall based on the visualization; and generating a control signal based on the visualization and the reference library when the fan is determined to be approaching incipient stall, the control signal for controlling operation of the fan in response thereto.

10. The apparatus of claim 9, wherein the processor creates the visualization using a symmetrized dot pattern (SDP) technique.

11. The apparatus of claim 9, wherein the signals are transmitted in intervals of 10 seconds.

12. The apparatus of claim 9, wherein the microphone has a frequency response of 5 Hz to 7 kHz +/−1dB and 3.15 Hz to 20 kHz +/−2dB.

13. The apparatus of claim 12, wherein the microphone has a lower limiting frequency of 1 Hz to 2 Hz.

14. The apparatus of claim 9, wherein the ducting has an inlet section four times the length of the diameter of the fan.

15. The apparatus of claim 9, wherein the acoustics of the air flow are measured over less than three revolutions of the fan.

16. The apparatus of claim 15, wherein the acoustics of the air flow are measured over less than one revolution of the fan.

17. The apparatus of claim 9, wherein the library of fixed visual representations is derived from a plurality of tests representative of the performance of the fan under a range of operating parameters.

18. The apparatus of claim 17 wherein the parameters include different operating speeds of the fan.

19. The apparatus of claim 18 wherein the range of operating parameters include at least one speed selected from 100%, 50% and 25% of the fan's rated speed.

* * * * *